US012371955B2

(12) United States Patent
Al-Jeffri et al.

(10) Patent No.: US 12,371,955 B2
(45) Date of Patent: Jul. 29, 2025

(54) PROVIDING LOST CIRCULATION MATERIAL TO CURE FLUID LOSSES IN A WELL

(71) Applicant: Saudi Arabian Oil Company, Dhahran (SA)

(72) Inventors: Ahmed Mohammed Al-Jeffri, Dhahran (SA); Victor Jose Bustamante Rodriguez, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/455,348

(22) Filed: Aug. 24, 2023

(65) Prior Publication Data

US 2025/0067132 A1 Feb. 27, 2025

(51) Int. Cl.
*E21B 21/00* (2006.01)

(52) U.S. Cl.
CPC ..... *E21B 21/003* (2013.01)

(58) Field of Classification Search
None
See application file for complete search history.

(56) References Cited

U.S. PATENT DOCUMENTS

| | | | |
|---|---|---|---|
| 2,014,563 | A | 9/1935 | Halliburton |
| 2,058,688 | A | 10/1936 | Halliburton |
| 2,801,715 | A | 8/1957 | Hall |
| 3,208,523 | A | 9/1965 | Coyle et al. |
| 4,289,632 | A | 9/1981 | Clear |
| 4,441,556 | A | 4/1984 | Powers et al. |
| 5,314,015 | A | 5/1994 | Streich et al. |
| 6,041,860 | A | 3/2000 | Nazzal et al. |
| 6,269,878 | B1 | 8/2001 | Wyatt et al. |
| 6,578,638 | B2 | 6/2003 | Guillory et al. |
| 7,717,179 | B2 | 5/2010 | Rayssiguier et al. |
| 8,371,381 | B2 | 2/2013 | Schlumberger et al. |
| 9,410,066 | B2 | 8/2016 | Ghassemzadeh |
| 9,688,901 | B2 | 6/2017 | Fontenot |
| 10,144,860 | B1 | 12/2018 | Reddy |
| 10,323,169 | B2 | 6/2019 | Jamison et al. |

(Continued)

FOREIGN PATENT DOCUMENTS

| | | |
|---|---|---|
| CA | 2541318 | 9/2007 |
| CA | 2943594 | 12/2015 |

(Continued)

*Primary Examiner* — Andrew Sue-Ako
(74) *Attorney, Agent, or Firm* — Fish & Richardson P.C.

(57) ABSTRACT

A system includes a drilling sub-system configured to form a wellbore from a terranean surface toward a subterranean formation by rotating a drill bit on a drill string; a drilling fluid circulation sub-system configured to circulate a drilling fluid downhole through the drill string, to and through the drill bit, into the wellbore, and uphole toward the terranean surface while the drilling sub-system drills the portion of the wellbore; and a lost circulation sub-system including a plurality of lost circulation material (LCM) pills configured to circulate, with the drilling fluid, through the drill string and the drill bit and into the wellbore in an inactive state. Each of the LCM pills is set to adjust from the inactive state to an active state to reduce at least a portion of the drilling fluid circulated into the wellbore that is lost to the subterranean formation.

24 Claims, 5 Drawing Sheets

(56) References Cited

U.S. PATENT DOCUMENTS

| | | | | |
|---|---|---|---|---|
| 10,941,326 | B2 | 3/2021 | Alouhali et al. | |
| 11,473,397 | B2 | 10/2022 | Egbe et al. | |
| 2004/0040707 | A1 | 3/2004 | Dusterhoft et al. | |
| 2004/0244978 | A1 | 12/2004 | Shaarpour | |
| 2007/0261850 | A1 | 11/2007 | Giroux et al. | |
| 2009/0183875 | A1 | 7/2009 | Rayssiguier et al. | |
| 2010/0181073 | A1 | 7/2010 | Dupriest et al. | |
| 2010/0193244 | A1* | 8/2010 | Hoskins | C09K 8/516 507/104 |
| 2011/0162844 | A1 | 7/2011 | Mauth | |
| 2017/0327726 | A1* | 11/2017 | Ramirez | C09K 8/426 |
| 2018/0037803 | A1* | 2/2018 | Dahi Taleghani | E21B 43/267 |
| 2020/0056446 | A1 | 2/2020 | Al-Mousa et al. | |
| 2021/0115755 | A1* | 4/2021 | Al-Abduljabbar | E21B 33/136 |
| 2021/0172281 | A1* | 6/2021 | Li | E21B 21/003 |
| 2022/0010651 | A1 | 1/2022 | Egbe et al. | |
| 2023/0015016 | A1 | 1/2023 | Egbe et al. | |

FOREIGN PATENT DOCUMENTS

| | | |
|---|---|---|
| WO | WO 2007092083 | 8/2007 |
| WO | WO 2011130350 | 10/2011 |
| WO | WO 2015191055 | 12/2015 |
| WO | WO 2017204784 | 11/2017 |

* cited by examiner

PROVIDING LOST CIRCULATION MATERIAL TO CURE FLUID LOSSES IN A WELL

TECHNICAL FIELD

This disclosure relates to systems and methods for providing a lost circulation material (LCM) to a reservoir.

BACKGROUND

During drilling operations, a drilling fluid may be "lost" to the formation due to instability or other issues with the formation that surrounds the wellbore. In some cases, a lost circulation material (LCM) is added to the drilling fluid to help stop the loss of drilling fluid to the formation. Reducing or stopping fluid losses during the drilling operations can enhance drilling practices and minimize any risk associated to well control or hole instability and also reduce any additional cost spent while controlling the fluid losses.

SUMMARY

In an example implementation, a method includes drilling at least a portion of a wellbore from a terranean surface toward a subterranean formation by rotating a drill bit on a drill string; while drilling the portion of the wellbore, circulating a drilling fluid downhole through the drill string, to and through the drill bit, into the wellbore, and uphole toward the terranean surface; determining that at least a portion of the drilling fluid circulated into the wellbore is lost to the subterranean formation and does not circulate uphole toward the terranean surface; based on the determination, circulating a plurality of lost circulation material (LCM) pills in an inactive state through the drill string and the drill bit and into the wellbore, each of the LCM pills set to adjust from the inactive state to an active state based on at least one wellbore criteria; emplacing the plurality of LCM pills at a location in which the portion of the drilling fluid circulated into the wellbore is lost to the subterranean formation; adjusting the plurality of LCM pills from the inactive state to the active state based on the at least one wellbore criteria; and reducing the portion of the drilling fluid circulated into the wellbore that is lost to the subterranean formation with the plurality of LCM pills in the active state.

In an aspect combinable with the example implementation, adjusting the plurality of LCM pills from the inactive state to the active state includes expanding each LCM pill from a contracted state to an expanded state to expose a lost circulation material mesh of the LCM pill from a housing of the LCM pill.

In another aspect combinable with any of the previous aspects, expanding each LCM pill from the contracted state to the expanded state to expose the lost circulation material mesh of the LCM pill from the housing of the LCM pill includes expanding a framework from within the housing to expose the lost circulation material mesh from the housing.

In another aspect combinable with any of the previous aspects, the lost circulation material mesh includes an acid-dissolvable fiber material.

In another aspect combinable with any of the previous aspects, the acid-dissolvable fiber material is configured to dissolve in the wellbore based on exposure to hydrochloric acid.

In another aspect combinable with any of the previous aspects, the at least one wellbore criteria includes a wellbore temperature at the location in which the portion of the drilling fluid circulated into the wellbore is lost to the subterranean formation.

Another aspect combinable with any of the previous aspects further includes adjusting the plurality of LCM pills from the inactive state to the active state based on a temperature sensor of each of the plurality of LCM pills sensing a temperature of at least the wellbore temperature at the location.

In another aspect combinable with any of the previous aspects, the at least one wellbore criteria includes a wellbore depth at the location in which the portion of the drilling fluid circulated into the wellbore is lost to the subterranean formation.

Another aspect combinable with any of the previous aspects further includes adjusting the plurality of LCM pills from the inactive state to the active state based on a depth sensor of each of LCM pills sensing a depth of at least the wellbore depth at the location.

Another aspect combinable with any of the previous aspects further includes setting a controller of each of the LCM pills with the at least one wellbore criteria at the terranean surface.

In another aspect combinable with any of the previous aspects, the at least one wellbore criteria includes a signal.

Another aspect combinable with any of the previous aspects further includes subsequent to emplacing the plurality of LCM pills at the location, circulating a signal generator through the drill string and the drill bit and into the wellbore with the drilling fluid; based on the signal generator reaching the location, activating the signal with the signal generator; and based on activation of the signal, adjusting the plurality of LCM pills from the inactive state to the active state.

In another aspect combinable with any of the previous aspects, the at least one wellbore criteria includes a time duration.

Another aspect combinable with any of the previous aspects further includes adjusting the plurality of LCM pills from the inactive state to the active state based on a timer of each of LCM pills reaching the time duration.

In another example implementation, a system includes a drilling sub-system configured to form at least a portion of a wellbore from a terranean surface toward a subterranean formation by rotating a drill bit on a drill string; a drilling fluid circulation sub-system configured to circulate a drilling fluid downhole through the drill string, to and through the drill bit, into the wellbore, and uphole toward the terranean surface while the drilling sub-system drills the portion of the wellbore; and a lost circulation sub-system including a plurality of lost circulation material (LCM) pills configured to circulate, with the drilling fluid, through the drill string and the drill bit and into the wellbore in an inactive state. Each of the LCM pills is set to adjust from the inactive state to an active state based on at least one wellbore criteria at a location of the wellbore in which a portion of the drilling fluid circulated into the wellbore is lost to the subterranean formation to reduce the portion of the drilling fluid circulated into the wellbore that is lost to the subterranean formation.

In an aspect combinable with the example implementation, each of the plurality of LCM pills is configured to adjust from the inactive state to the active state by expanding from a contracted state to an expanded state to expose a lost circulation material mesh of the LCM pill from a housing of the LCM pill.

In another aspect combinable with any of the previous aspects, each of the plurality of LCM pills is configured to expand from the contracted state to the expanded state to expose the lost circulation material mesh of the LCM pill from the housing of the LCM pill by expanding a framework from within the housing to expose the lost circulation material mesh from the housing.

In another aspect combinable with any of the previous aspects, the lost circulation material mesh includes an acid-dissolvable fiber material.

In another aspect combinable with any of the previous aspects, the acid-dissolvable fiber material is configured to dissolve in the wellbore based on exposure to hydrochloric acid.

In another aspect combinable with any of the previous aspects, the at least one wellbore criteria includes a wellbore temperature at the location in which the portion of the drilling fluid circulated into the wellbore is lost to the subterranean formation.

In another aspect combinable with any of the previous aspects, each of the plurality of LCM pills is configured to adjust from the inactive state to the active state based on a temperature sensor of each of the plurality of LCM pills sensing a temperature of at least the wellbore temperature at the location.

In another aspect combinable with any of the previous aspects, the at least one wellbore criteria includes a wellbore depth at the location in which the portion of the drilling fluid circulated into the wellbore is lost to the subterranean formation.

In another aspect combinable with any of the previous aspects, each of the plurality of LCM pills is configured to adjust from the inactive state to the active state based on a depth sensor of each of LCM pills sensing a depth of at least the wellbore depth at the location.

In another aspect combinable with any of the previous aspects, each of the LCM pills includes a controller configured to be set with the at least one wellbore criteria at the terranean surface.

In another aspect combinable with any of the previous aspects, the at least one wellbore criteria includes a signal.

In another aspect combinable with any of the previous aspects, the lost circulation sub-system includes a signal generator configured to circulate through the drill string and the drill bit and to the location in the wellbore with the drilling fluid and activate the signal to adjust the plurality of LCM pills from the inactive state to the active state.

In another aspect combinable with any of the previous aspects, the at least one wellbore criteria includes a time duration, and each of the plurality of LCM pills is configured to adjust from the inactive state to the active state based on a timer of each of LCM pills reaching the time duration.

In another example implementation, a lost circulation material (LCM) pill includes a housing; a framework coupled to the housing and configured to adjust from a retracted state enclosed within the housing to an expanded state outside of the housing; and a fiber material that forms a mesh across and coupled to the framework, the mesh exposed from the housing when the framework in the expanded state.

In an aspect combinable with the example implementation, the housing is spherical.

In another aspect combinable with any of the previous aspects, the fiber material includes an acid-dissolvable material.

Another aspect combinable with any of the previous aspects further includes a controller coupled to at least one of the housing or the framework.

In another aspect combinable with any of the previous aspects, the controller includes a programmable radio frequency identification (RFID) tag configured to adjust the framework from the retracted state to the expanded state upon receipt of a signal.

In another aspect combinable with any of the previous aspects, the controller includes at least one sensor configured to sense a value of a wellbore parameter, the controller configured to adjust the framework from the retracted state to the expanded state based on the sensor sensing the value of the wellbore parameter.

Implementations of a systems and methods for providing LCM to a reservoir according to the present disclosure may include one or more of the following features. For example, implementations according to the present disclosure can cure or control drilling fluid losses while drilling an oil, gas and water well. Also, implementations according to the present disclosure can overcome drilling fluid losses by the use of mechanical LCM system allowing the continuous operations of drilling a well. Further, implementations according to the present disclosure can avoid reservoir damages by using acid soluble LCM material components to complete a well. As a further example, implementations according to the present disclosure can use LCM material applicable n any type of environment and independent of fracture size or losses rate. Also, implementations according to the present disclosure can minimize extensive lost time due to drilling fluid losses while also controlling such losses. Further, implementations according to the present disclosure can avoid risks associated to drilling fluid losses in an oil, gas o water well related to well control, while curing or controlling the fluid losses in the well.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes implementations of a lost circulation material (LCM) as well as methods and systems for delivering the LCM to a downhole reservoir (for example, during a drilling operation) to reduce or cease a loss of drilling fluid. Reducing lost drilling fluid can be an important consideration during drilling operations. For example, some of the purposes of the drilling fluid are to: provide support of the wellbore (in other words, the rock formation) while drilling the wellbore, act a lubricant to a drill string that it is used to drill the wellbore, and provide hydraulic forces to move drilling tools and prevent well control events when the drilling fluid weight is higher than a reservoir formation pressure. Thus, maintaining drilling fluid in the wellbore at all time can be important and, when severe to total losses of drilling fluid are encountered, the whole drilling operation is disrupted while trying to control such losses.

Figure 1:
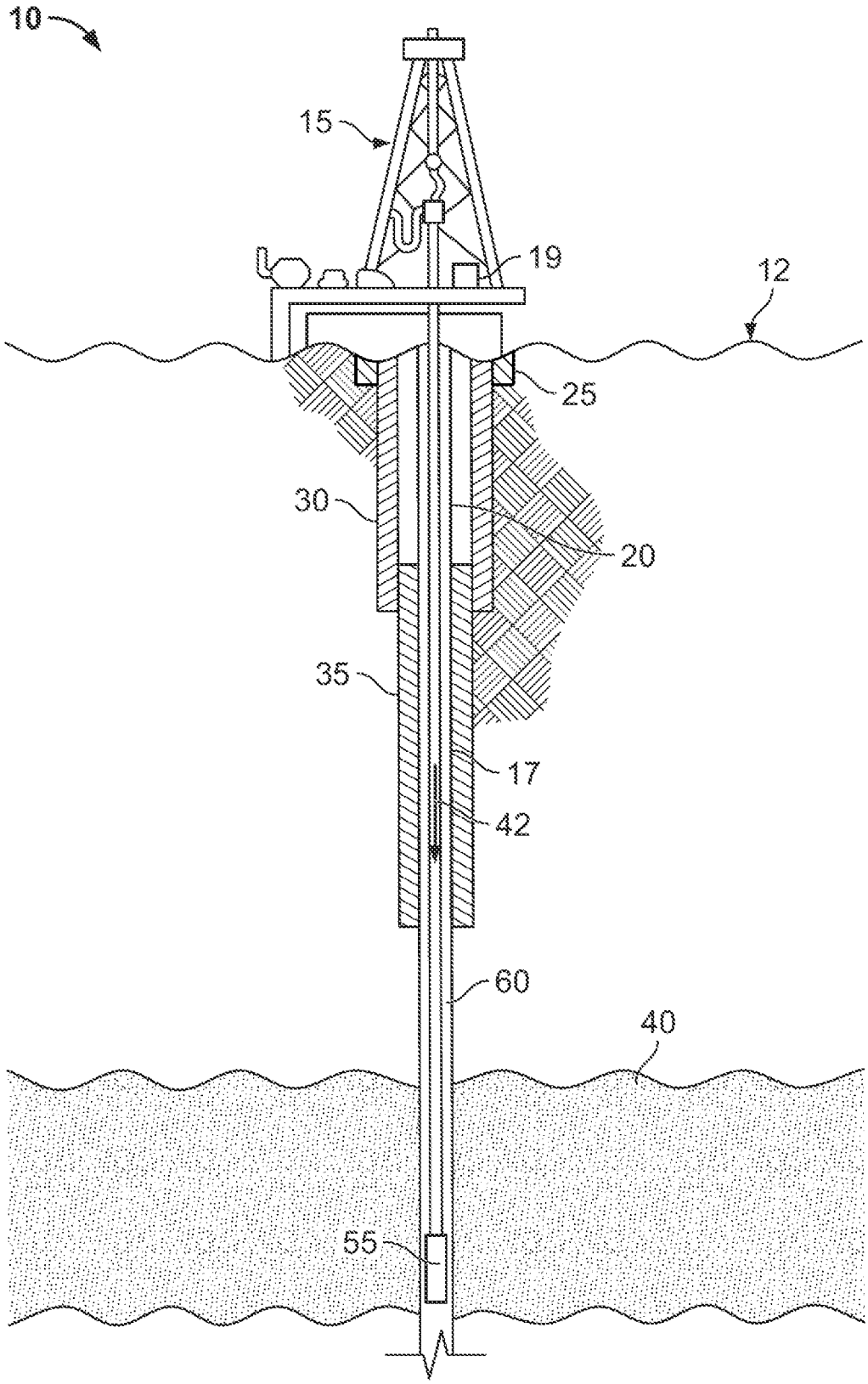
FIG. 1 is a schematic diagram of an example wellbore system that includes a drill string operable to deliver lost circulation material (LCM) to a reservoir according to the present disclosure.

FIG. 1 is a schematic diagram of an example wellbore system 10 that operates to deliver LCM pills to a location in a wellbore 20 according to the present disclosure. Implementations according to the present disclosure describe an LCM pill that, in some aspects, is spherically or pill shaped in an inactive (or contracted) state. Thus, although the term "pill" refers to a shape that can be generally spherical or capsule shaped, the present disclosure does not exclude LCM pills of different three-dimensional shapes when in an inactive state.

Multiple (for example, tens, hundreds, thousands) of LCM pills can be circulated into the wellbore 20 through the drilling string. The LCM pills can be circulated in a drilling or other wellbore fluid through downhole tools, such as conventional rotary assemblies without any special tool on it or through open ended drill pipe. Circulation techniques of the LCM pills can depend, for example, on wellbore diameter, the size of the tools used in the drill string, a severity of the drilling fluid losses experienced during a drilling process, and/or other factors. Thus, implementations of the LCM pills according to the present disclosure can have different external dimensions (lengths, circumferences, or otherwise) in order to have different alternative for uses.

Once undesired drilling fluid losses occur, LCM pills can be inserted into the drilling equipment (for example, into a drill pipe or string 17) and circulated downhole, where they are positioned at or near a bottom of the wellbore 20 or wherever drilling fluid losses are occurring. In some aspects, once the LCM pills are emplaced, the drill string 17 can be pulled out of the wellbore 20. Further in some aspects, in order to ensure or help ensure that the LCM pills move into the fracture or loss zone (in other words, the location in the reservoir where drilling fluid losses are occurring), a squeeze operation can be performed by applying pressure in the wellbore 20 in an annular space (or annulus) 60 in order to further push or urge (or circulate) the LCM pills into the loss zone.

After the LCM pills are emplaced into the reservoir, the LCM pills adjust from the inactive state to an active or expanded state to expose a larger cross-section of LCM. For example, in some examples and as described herein, in an active state, the LCM pills can take the shape of a spiderweb or other shape that is more planar than a sphere or pill. This expanded shape can more efficiently (as compared to a sphere or pill shape), cover zones of drilling fluid loss in the reservoir. In some aspects, as multiple LCM pills are circulated into the loss zone, the activated LCM pills form a larger mesh structure with overlapping or adjacent spiderweb structures to block or act as a bridging mechanism to seal the loss zone in which drilling fluid is lost into the reservoir.

As shown, the wellbore system 10 accesses a subterranean formation 40, and provides access to hydrocarbons located in such subterranean formation 40, also called reservoir 40. In an example implementation of system 10, the system 10 may be used for a drilling operation as well as to deliver LCM pills (shown in FIGS. 2A and 2B). As illustrated in FIG. 1, an implementation of the wellbore system 10 includes a drilling assembly 15 deployed on a terranean surface 12. The drilling assembly 15 can be used to form the wellbore 20 extending from the terranean surface 12 and through one or more geological formations in the Earth. One or more subterranean formations, such as subterranean zone 40, are located under the terranean surface 12. One or more wellbore casings, such as a surface casing 30 and intermediate casing 35, may be installed in at least a portion of the wellbore 20 (for example subsequent to completion of the drilling operation or some other time).

In some embodiments, the drilling assembly 15 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

Generally, as a drilling system, the drilling assembly 15 may be any appropriate assembly or drilling rig used to form wellbores or boreholes in the Earth. The drilling assembly 15 may use traditional techniques to form such wellbores, such as the wellbore 20, or may use nontraditional or novel techniques. In some embodiments, the drilling assembly 15 may use rotary drilling equipment to form such wellbores. Rotary drilling equipment is known and may consist of a drill string 17 and the drill bit 55 (or bottom hole assembly 55 that includes a drill bit). In some embodiments, the drilling assembly 15 may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string 17. The drill string 17 is typically attached to the drill bit 55 (for example, as a bottom hole assembly). A swivel, which is attached to hoisting equipment, carries much, if not all of, the weight of the drill string 17, but may allow it to rotate freely.

The drill string 17 typically consists of sections of heavy steel pipe, which are threaded so that they can interlock together. Below the drill pipe are one or more drill collars, which are heavier, thicker, and stronger than the drill pipe. The threaded drill collars help to add weight to the drill string 17 above the drill bit to ensure that there is enough downward force on the drill bit 55 to allow the bit to drill through the one or more geological formations. The number and nature of the drill collars on any particular rotary rig may be altered depending on the downhole conditions experienced while drilling.

The circulating system of a rotary drilling operation, such as the drilling assembly 15, may be an additional component of the drilling assembly 15. Generally, the circulating system may cool and lubricate the drill bit, removing the cuttings from the drill bit and the wellbore 20 (for example, through an annulus 60), and coat the walls of the wellbore 20 with a mud type cake. The circulating system consists of drilling fluid 42, which is circulated down through the wellbore throughout the drilling process. Typically, the components of the circulating system include drilling fluid pumps, compressors, related plumbing fixtures, and specialty injectors for the addition of additives to the drilling fluid 42. In some embodiments, such as, for example, during a horizontal or directional drilling process, downhole motors may be used in conjunction with or in the drill bit 55. Such a downhole motor may be a mud motor with a turbine arrangement, or a progressive cavity arrangement, such as a Moineau motor. These motors receive the drilling fluid 42 through the drill string 17 and rotate to drive the drill bit or change directions in the drilling operation.

In many rotary drilling operations, the drilling fluid 42 is pumped down the drill string 17 and out through ports or jets in the drill bit. The fluid then flows up toward the surface 12 within annulus 60 between the wellbore 20 and the drill string 17, carrying cuttings in suspension to the surface. The drilling fluid 42, much like the drill bit, may be chosen depending on the type of geological conditions found under subterranean surface 12.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

In some aspects, the drilling assembly 15 (or other portion of the well system 10) may include a control system 19, for example, microprocessor-based, electro-mechanical, or otherwise, that may control the drill bit 55. In some aspects, the control system 19 may control one or more pumps, one or more valves, as well as other equipment that is part of or connected to the drilling fluid circulation system. For example, the control system 19 may control a flow rate, pressure, or other circulation criteria of the drilling fluid 42 (and thus, a rate at which LCM pills are circulated with the drilling fluid 42). In some aspects, the control system 19 may also control a composition of the drilling fluid 42 such as, a water percentage of the fluid, or an additive that may be mixed with the drilling fluid 42.

Figure 2B:
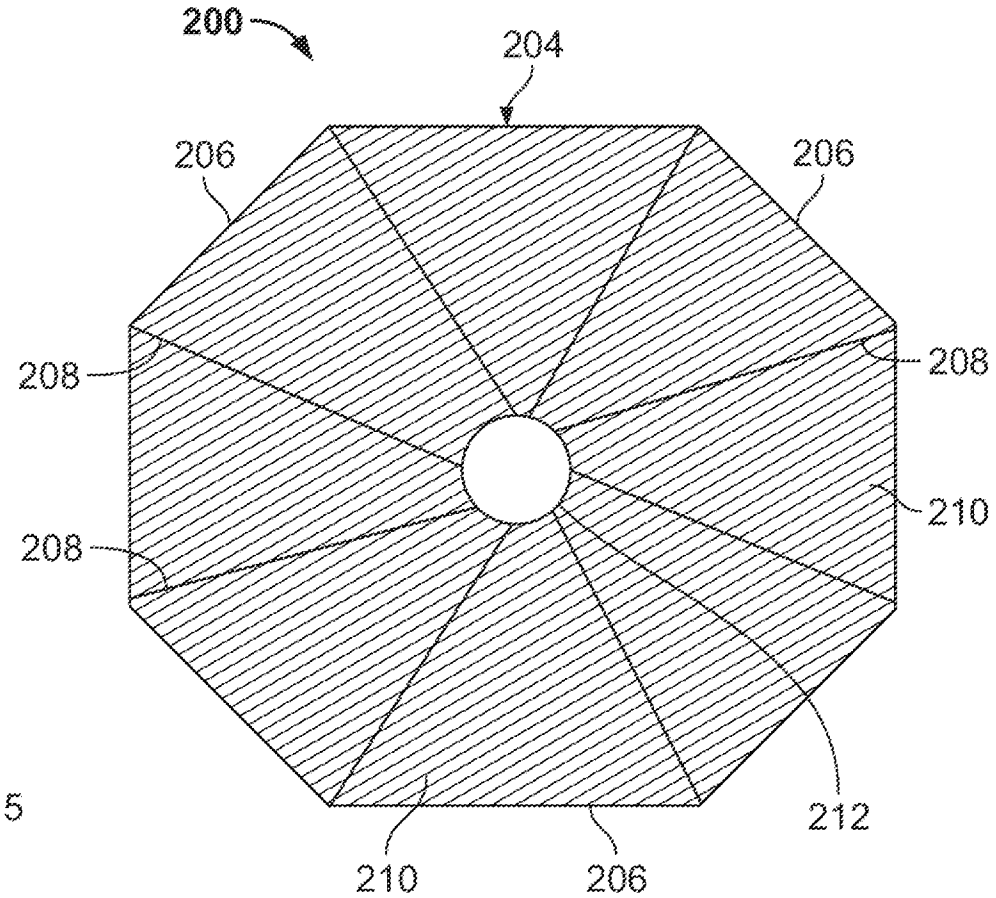
FIG. 2B is a schematic diagram of the LCM pill in an active or expanded state according to the present disclosure.
Figure 2C:
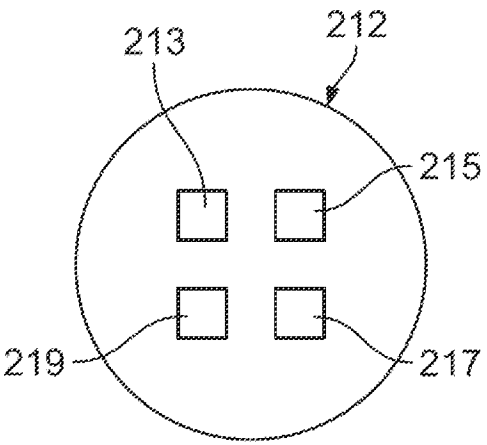
FIG. 2C is a schematic diagram of a portion of the LCM pill according to the present disclosure.
Figure 2A:
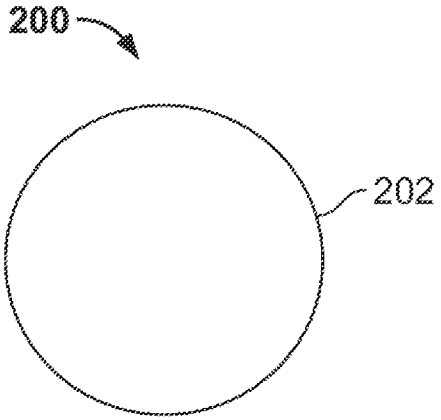
FIG. 2A is a schematic diagram of an example implementation of an LCM pill in an inactive or contracted state according to the present disclosure.

FIG. 2A is a schematic diagram of an example implementation of an LCM pill 200 in an inactive or contracted state according to the present disclosure. As shown in this example, the LCM pill 200 includes a housing 202, which, as shown, is spherical or substantially spherical. However, alternative implementations can include a housing 202 that is capsule shaped or oblong or in another three-dimensional shape. The housing 202 can be sized, for example, based on characteristics of the drilling equipment, such as diameter of the drill string 17, size of the drill bit 55, amount of loss of drilling fluid 42, or other characteristics. Housing 202 can provide an outer enclosure that the LCM pill 200 travels through the drilling fluid 42 during circulation into the wellbore 20 in an inactive (or contracted) state. The housing 202 can comprise a material that allows the LCM 200 to remain in a rigid or substantially rigid shape during emplacement in the wellbore 20, such as plastic fiber or a similar material. However, the material of the housing 202 can also have enough flexibility to allow and facilitate the LCM pill 200 to adjust from the inactive state to an active or expended state, as shown in FIG. 2A.

FIG. 2B is a schematic diagram of the LCM pill 200 in an active or expanded state according to the present disclosure. As shown in this figure, once activated or expanded (for instance, mechanically) based on a particular activation criteria or signal, the housing 202 expands or opens to allow framework 204 to expand. In some aspects, the framework 204, which includes multiple perimeter members 206 and multiple interior members 208, is completely enclosed within the housing 202 and upon opening or breaking of the housing 202, expands as shown in FIG. 2B. Alternatively, the framework 204 can be part of or integrally formed with the housing 202.

In this example, the perimeter members 206 connect to form an octagonal perimeter shape, with the interior members 208 connected to the perimeter members 206 (like spokes in a wheel) as well as to a controller 212 at a center of the framework 204. Each of the members 206 and 208 can be formed from a rigid but bendable material that allows for the contraction as well as expansion of the framework 204 when the LCM pill 200 adjusts from the inactive state to the active state.

As shown in this example implementation, the LCM 200 includes a mesh 210 that connects between the members 206 and 208 of the framework 204 (and is held in place by the framework 204) to form a "web." The mesh 210, in some examples, is comprised of a fiber material that can act as a barrier to fluid flow therethrough, thereby allowing the LCM pill 200 (when emplaced in the wellbore 20 and activated) to stop or reduce drilling fluid loss. In some aspects, the fiber material can dissolve or otherwise be soluble in an acid, such as hydrochloric acid, thereby allowing the LCM pill 200 to largely dissolve in the wellbore 20 in an acid job when no longer needed. Thus, LCM pills 200 that are emplaced within the reservoir 40 can be removed (for example, dissolved) and will not act to damage the reservoir or equipment when not needed.

The example implementation of the LCM 200 shown in FIG. 2B includes a controller 212 that, in this example, is positioned in a center of the framework 204 and within the housing 202. In some aspects, the controller 212 is or encloses one or more sensors, each of which is operable to detect or measure a particular wellbore criteria or signal. When the measured wellbore criteria or detected signal reaches a particular preset value, the controller 212 can operate to release the framework 204 or otherwise adjust the LCM pill 200 from the inactive state to the active state.

FIG. 2C is a schematic diagram of an example implementation of the controller 212 of the LCM pill 200 according to the present disclosure. In this example, the controller 212 is shown as including or being multiple sensors 213, 215, 217, and 219. However, implementations of the controller 212 can include or be only one sensor, only two sensors, only three sensors, or other number of sensors. In some aspects, multiple sensors can be included in or as the controller 212, with one sensor being a primary trigger to adjust the LCM pill 200 from the inactive state to the active state, and one or more other sensors being backup triggers that is each operable to adjust the LCM pill 200 from the inactive state to the active state in case of a failure by the primary trigger.

In this example, sensor 213 is an RFID tag 213 (such as a pre-programmed RFID tag 213). For example, the LCM 200 can be adjusted from the inactive state to the active state based on the RFID tag 213 receiving or sensing a particular signal. The LCM pill 200 can include the RFID tag 213, which is programed at the terranean surface 12 prior to circulation of the LCM pill 200 into the wellbore 20. A separate RFID chip can be dropped from surface 12 into the wellbore 20 and circulated to the location of the emplaced LCM pill 200 in drilling fluid 42. When the chip is within the range of the RFID tag 213, the tag 213 will activate, for example, an expanding mechanism to expand the framework 204 to adjust the LCM pill 200 from the inactive state to the active state (and expose the mesh 210).

As another example trigger mechanism, the sensor 215 can be a temperature sensor 215. For example, by knowing a fluid temperature and formation temperature where the drilling fluid losses are expected and then encountered, the LCM pill 200 can include a temperature sensor 215 that senses the wellbore temperature. Upon measuring a preset temperature value for the wellbore temperature (in other words, the temperature expected at the loss location), the temperature sensor 215 can activate, for example, the expanding mechanism to expand the framework 204 to adjust the LCM pill 200 from the inactive state to the active state (and expose the mesh 210). In some aspects, the preset temperature is a preset temperature range.

As another example trigger mechanism, the sensor 217 can be a timer 217. For example, by determining an expected amount of time that it will take the LCM pill 200 to reach the loss zone, the timer 217 can be preset with at least that amount of time. Once the timer 217 reaches the preset time duration, the timer 217 can activate, for example, the expanding mechanism to expand the framework 204 to adjust the LCM pill 200 from the inactive state to the active state (and expose the mesh 210). In some aspects, the timer 217 can be included in controller 212 along with at least one additional trigger that acts as a primary trigger, where the timer 217 acts as a backup trigger.

As another example trigger mechanism, the sensor 219 can be a depth sensor 219. For example, by knowing a wellbore depth where the drilling fluid losses are expected and then encountered, the LCM pill 200 can include a depth sensor 219 that senses the wellbore depth. Upon measuring a preset depth value for the wellbore depth (in other words, the depth at which the LCM pill 200 is emplaced in the wellbore 20 at the loss location), the depth sensor 219 can activate, for example, the expanding mechanism to expand the framework 204 to adjust the LCM pill 200 from the inactive state to the active state (and expose the mesh 210). In some aspects, the preset depth is a preset depth range.

Figure 3A:
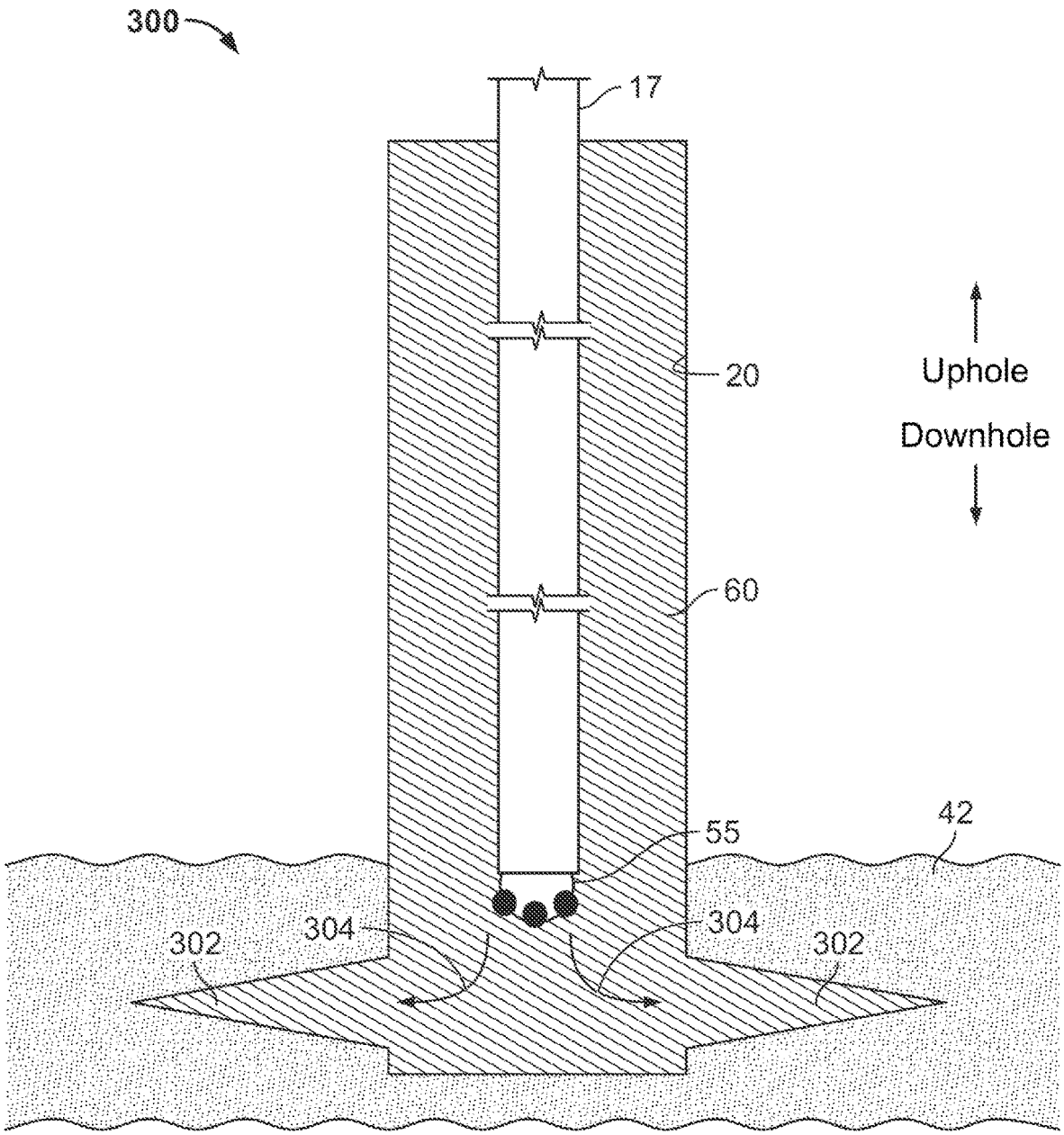
FIGS. 3A-3C are schematic diagrams of an operation to deliver LCM pills to a reservoir for reducing drilling fluid losses according to the present disclosure.
Figure 3B:
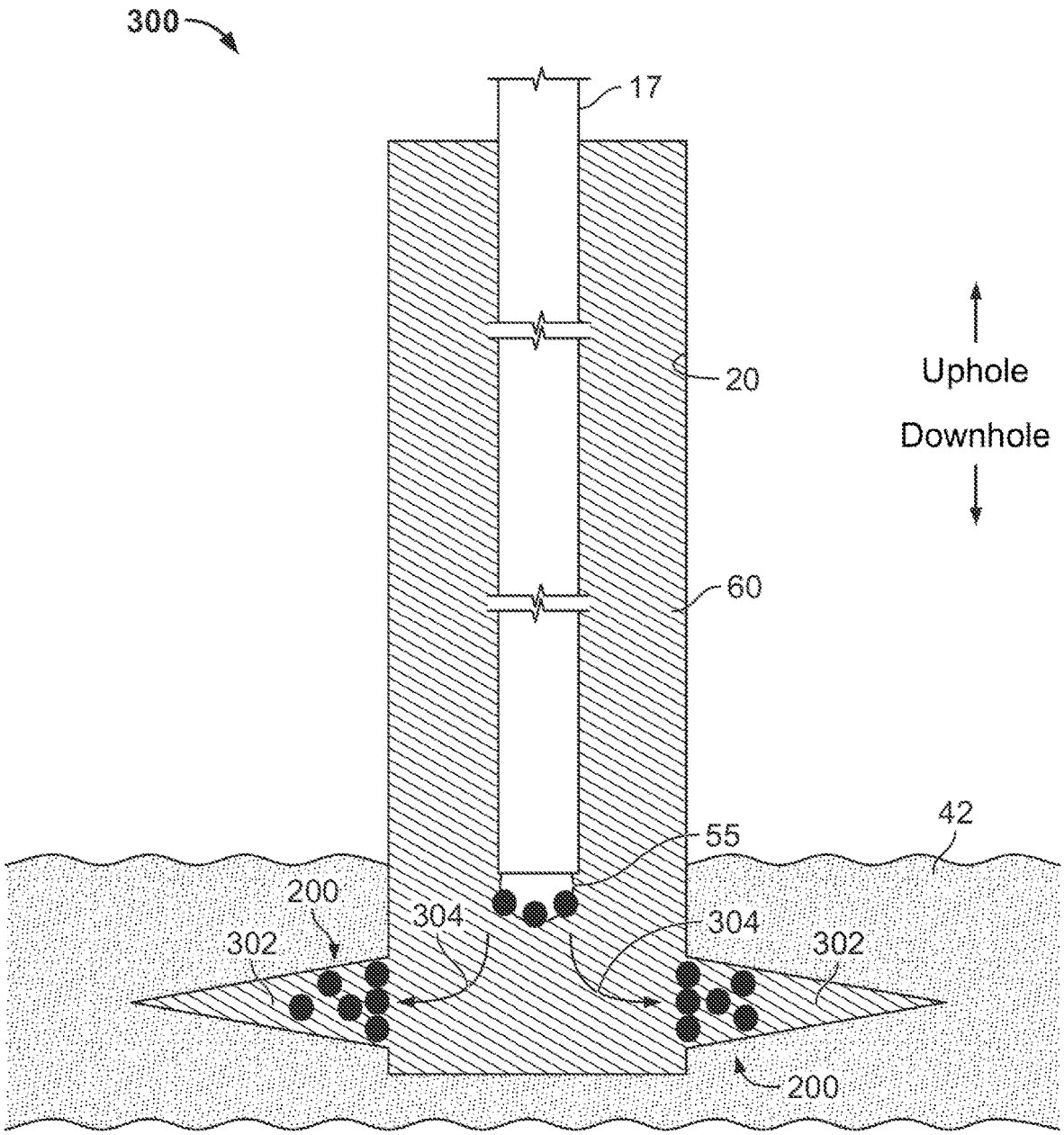
Figure 3C:
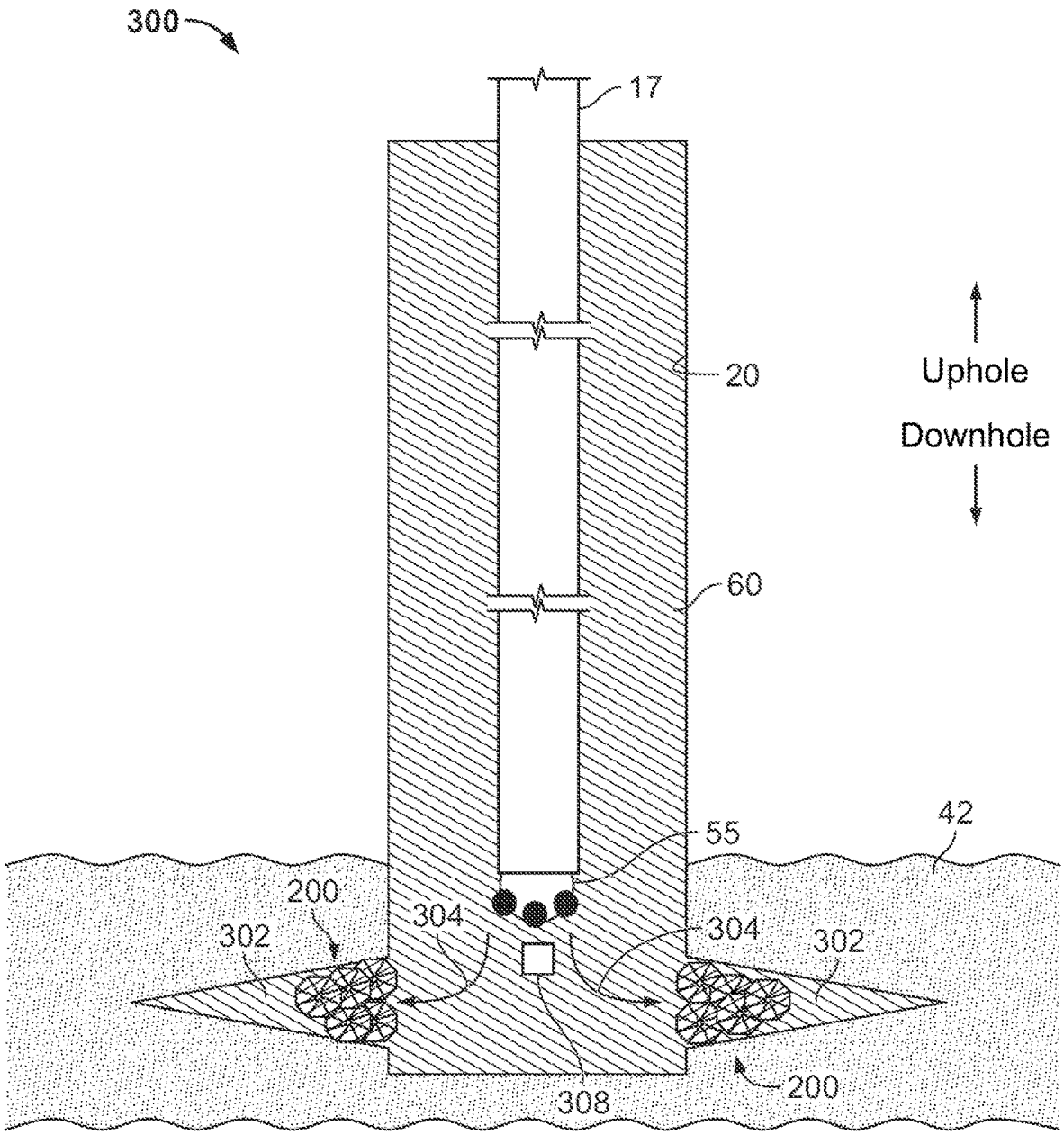

FIGS. 3A-3C are schematic diagrams of an operation 300 to deliver LCM pills 200 to a reservoir 40 for reducing drilling fluid losses according to the present disclosure. Turning first to FIG. 3A, a first step (or first set of steps) of operation 300 is shown. In this figure, drilling fluid 304 is circulated through drill string 17 and to the drill bit 55, out of which it exits into the annulus 60 of the wellbore 20. Here, loss zones 302 represent a wellbore location at which undesirable drilling fluid losses are occurring. For example, drilling fluid losses can be categorized in several different magnitudes, including: seepage losses<20 bbls/hr; partial losses 20-100 bbls/hr; or major losses>100 bbls/hr. Loss zones 302 are fluid pathways for drilling fluid 304 to circulate into the reservoir 40 without returning uphole through the annulus 60.

When undesirable drilling fluid losses are encountered, the operation 300 turns to FIG. 3B. In this figure, multiple (tens, hundreds, thousands) of LCM pills 200 are circulated with drilling fluid 304 through the drill string 27, out of the drill bit 55, and with the drilling fluid 304 to the loss zones 302. A quantity of LCM pills 200 can depend on, for example, the category of drilling fluid loss being experienced (for example, how many bbl/hr drilling fluid loss). As shown in FIG. 3B, the LCM pills 200 are circulated to the loss zones 302 in an inactive state (not expanded and still within housing 202). Multiple LCM pills 200 can be emplaced in each loss zone 302 as needed.

Operation 300 turns to FIG. 3C, which represents adjustment of the emplaced LCM pills 200 from the inactive or contracted state to the active or expanded state to expose the mesh 210 to the drilling fluid 304. In this example, as shown in FIG. 3C, once emplaced, an RFID chip 308 can be circulated with drilling fluid 304 into the loss zone 302. As the LCM pills 200 (in this example) include pre-programmed RFID tags 213, once the RFID chip 308 is close enough so that a signal from chip 308 is sensed or received by the RFID tags 213, the tags 213 expand the LCM pills 200 to expose the mesh 210 within the loss zones 302. The mesh 210, for example, as a fibrous material, acts to block drilling fluid 304 from circulating into the loss zones 302, thereby forcing more drilling fluid 304 back uphole in the annulus 60.

Although FIG. 3C shows activation of the LCM pills 200 with the RFID tags 213, other sensors, such as depth, temperature, or the timer as previously described can also be used in operation 300 (as a primary trigger or backup trigger) to activate the LCM pills 200. Other sensor types, such as salinity and/or hydrocarbon phase composition can also be used as triggers to activate the LCM pills 200.

After the activated LCM pills 200 are exposed into the reservoir 40, they combine to create a spiderweb type shape with the fabric material 210, which will cover the loss zones 302 to present or reduce drilling fluid losses. In some aspects, due to an amount of LCM pills 200 pumped at the same time, all the fabric materials 210 together inside the loss zones 302 will expand simultaneously, creating this blocked or bridging mechanism sealing the fracture or cavern which is causing the loss of drilling fluid 304

Once drilling fluid losses have reduced or been abated, operation 300 can also include removing the activated LCM pills 200. For example, the mesh 210 can be acid-soluble. Thus, by circulating an acid (for example, hydrochloric acid) with the drilling fluid 304, the LCM pills 200 can largely dissolve and the wellbore can be completed or otherwise continue drilling.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A method, comprising:

drilling at least a portion of a wellbore from a terranean surface toward a subterranean formation by rotating a drill bit on a drill string;

while drilling the portion of the wellbore, circulating a drilling fluid downhole through the drill string, to and through the drill bit, into the wellbore, and uphole toward the terranean surface;

determining that at least a portion of the drilling fluid circulated into the wellbore is lost to the subterranean formation and does not circulate uphole toward the terranean surface;

based on the determination, circulating a plurality of lost circulation material (LCM) pills in a contracted state through the drill string and the drill bit and into the wellbore, each of the LCM pills comprising a framework of rigid but bendable material that is set to adjust from the contracted state to an expanded state based on at least one wellbore criteria;

emplacing the plurality of LCM pills at a location in which the portion of the drilling fluid circulated into the wellbore is lost to the subterranean formation;

adjusting the plurality of LCM pills from the contracted state to the expanded state based on the at least one wellbore criteria, the adjusting comprising:

for each LCM pill, releasing a plurality of interior members of the framework of the LCM pill from a controller based on a trigger for the at least one wellbore criteria, and upon release of the one or more interior members of the framework from the controller, expanding a plurality of perimeter members of the framework that are connected to the plurality of interior members to expand the framework of the LCM pill; and reducing the portion of the drilling fluid circulated into the wellbore that is lost to the subterranean formation with the plurality of LCM pills in the expanded state.

2. The method of claim 1, comprising exposing a lost circulation material mesh of the LCM pill from a housing of the LCM pill by adjusting the plurality of LCM pills from the contracted state to the expanded state.

3. The method of claim 2, comprising expanding the framework from within the housing to expose the lost circulation material mesh from the housing.

4. The method of claim 3, wherein the lost circulation material mesh comprises an acid-dissolvable fiber material.

5. The method of claim 4, wherein the acid-dissolvable fiber material is configured to dissolve in the wellbore based on exposure to hydrochloric acid.

6. The method of claim 2, wherein the lost circulation material mesh comprises an acid-dissolvable fiber material.

7. The method of claim 6, wherein the acid-dissolvable fiber material is configured to dissolve in the wellbore based on exposure to hydrochloric acid.

8. The method of claim 1, wherein the at least one wellbore criteria comprises a wellbore temperature at the location in which the portion of the drilling fluid circulated into the wellbore is lost to the subterranean formation, the method further comprising:

adjusting the plurality of LCM pills from the contracted state to the expanded state based on a temperature sensor of each of the plurality of LCM pills sensing a temperature of at least the wellbore temperature at the location.

9. The method of claim 1, wherein the at least one wellbore criteria comprises a wellbore depth at the location in which the portion of the drilling fluid circulated into the wellbore is lost to the subterranean formation, the method further comprising:

adjusting the plurality of LCM pills from the contracted state to the expanded state based on a depth sensor of each of LCM pills sensing a depth of at least the wellbore depth at the location.

10. The method of claim 1, further comprising setting the controller of each of the LCM pills with the at least one wellbore criteria at the terranean surface.

11. The method of claim 10, wherein the at least one wellbore criteria comprises a signal, the method further comprising:

subsequent to emplacing the plurality of LCM pills at the location, circulating a signal generator through the drill string and the drill bit and into the wellbore with the drilling fluid;

based on the signal generator reaching the location, activating the signal with the signal generator; and based on activation of the signal, adjusting the plurality of LCM pills from the contracted state to the expanded state.

12. The method of claim 10, wherein the at least one wellbore criteria comprises a time duration, the method further comprising:

adjusting the plurality of LCM pills from the contracted state to the expanded state based on a timer of each of LCM pills reaching the time duration.

13. A method, comprising:

setting a controller of each of a plurality of lost circulation material (LCM) pills with at least one wellbore criteria at a terranean surface;

drilling at least a portion of a wellbore from the terranean surface toward a subterranean formation by rotating a drill bit on a drill string;

while drilling the portion of the wellbore, circulating a drilling fluid downhole through the drill string, to and through the drill bit, into the wellbore, and uphole toward the terranean surface;

determining that at least a portion of the drilling fluid circulated into the wellbore is lost to the subterranean formation and does not circulate uphole toward the terranean surface;

based on the determination, circulating the plurality of LCM pills in a contracted state through the drill string and the drill bit and into the wellbore, each of the LCM pills comprising a framework of rigid but bendable material that is set to adjust from the contracted state to an expanded state based on the at least one wellbore criteria, the at least one wellbore criteria comprising a wellbore temperature at a location in which the portion of the drilling fluid circulated into the wellbore is lost to the subterranean formation;

emplacing the plurality of LCM pills at the location in which the portion of the drilling fluid circulated into the wellbore is lost to the subterranean formation;

adjusting the plurality of LCM pills from the contracted state to the expanded state based on a temperature sensor of each of the plurality of LCM pills sensing a temperature of at least the wellbore temperature at the location, the adjusting comprising:

for each LCM pill, releasing a plurality of interior members of the framework of the LCM pill from a controller based on a trigger for the wellbore temperature, and upon release of the one or more interior members of the framework from the controller, expanding a plurality of perimeter members of the framework that are connected to the plurality of interior members to expand the framework of the LCM pill; and reducing the portion of the drilling fluid circulated into the wellbore that is lost to the subterranean formation with the plurality of LCM pills in the expanded state.

14. The method of claim 13, comprising exposing a lost circulation material mesh of the LCM pill from a housing of the LCM pill by adjusting the plurality of LCM pills from the contracted state to the expanded state.

15. The method of claim 14, comprising expanding the framework from within the housing to expose the lost circulation material mesh from the housing.

16. The method of claim 15, wherein the lost circulation material mesh comprises an acid-dissolvable fiber material.

17. The method of claim 16, wherein the acid-dissolvable fiber material is configured to dissolve in the wellbore based on exposure to hydrochloric acid.

18. The method of claim 14, wherein the lost circulation material mesh comprises an acid-dissolvable fiber material.

19. The method of claim 18, wherein the acid-dissolvable fiber material is configured to dissolve in the wellbore based on exposure to hydrochloric acid.

20. A method, comprising:

setting a controller of each of a plurality of lost circulation material (LCM) pills with at least one wellbore criteria at a terranean surface;

drilling at least a portion of a wellbore from the terranean surface toward a subterranean formation by rotating a drill bit on a drill string;

while drilling the portion of the wellbore, circulating a drilling fluid downhole through the drill string, to and through the drill bit, into the wellbore, and uphole toward the terranean surface;

determining that at least a portion of the drilling fluid circulated into the wellbore is lost to the subterranean formation and does not circulate uphole toward the terranean surface;

based on the determination, circulating the plurality of LCM pills in a contracted state through the drill string and the drill bit and into the wellbore, each of the LCM pills comprising a framework of rigid but bendable material that is set to adjust from the contracted state to an expanded state based on the at least one wellbore criteria;

emplacing the plurality of LCM pills at a location in which the portion of the drilling fluid circulated into the wellbore is lost to the subterranean formation;

adjusting the plurality of LCM pills from the contracted state to the expanded state based on the at least one wellbore criteria, the adjusting comprising:

for each LCM pill, releasing a plurality of interior members of the framework of the LCM pill from a controller based on a trigger for the at least one wellbore criteria, and upon release of the one or more interior members of the framework from the controller, expanding a plurality of perimeter members of the framework that are connected to the plurality of interior members to expand the framework of the LCM pill;

exposing a lost circulation material mesh coupled within the framework of the LCM pill from a housing of the LCM pill by adjusting the plurality of LCM pills from the contracted state to the expanded state; and reducing the portion of the drilling fluid circulated into the wellbore that is lost to the subterranean formation with the exposed lost circulation material mesh of the plurality of LCM pills in the expanded state.

21. The method of claim 20, comprising expanding the framework from within the housing to expose the lost circulation material mesh from the housing.

22. The method of claim 20, wherein the lost circulation material mesh comprises an acid-dissolvable fiber material.

23. The method of claim 22, wherein the acid-dissolvable fiber material is configured to dissolve in the wellbore based on exposure to hydrochloric acid.

24. The method of claim 20, wherein the at least one wellbore criteria comprises a wellbore temperature at the location in which the portion of the drilling fluid circulated into the wellbore is lost to the subterranean formation, the method further comprising:

adjusting the plurality of LCM pills from the contracted state to the expanded state based on a temperature sensor of each of the plurality of LCM pills sensing a temperature of at least the wellbore temperature at the location.

* * * * *